US009395105B2

(12) United States Patent
Shimazu et al.

(10) Patent No.: US 9,395,105 B2
(45) Date of Patent: Jul. 19, 2016

(54) REFRIGERATION CYCLE DEVICE

(75) Inventors: Yusuke Shimazu, Tokyo (JP); Keisuke Takayama, Tokyo (JP); Masayuki Kakuda, Tokyo (JP); Hideaki Nagata, Tokyo (JP); Takeshi Hatomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 241 days.

(21) Appl. No.: 14/236,956

(22) PCT Filed: Sep. 1, 2011

(86) PCT No.: PCT/JP2011/004920

§ 371 (c)(1),
(2), (4) Date: Feb. 4, 2014

(87) PCT Pub. No.: WO2013/030896

PCT Pub. Date: Mar. 7, 2013

(65) Prior Publication Data

US 2014/0157811 A1 Jun. 12, 2014

(51) Int. Cl.

| | |
|---|---|
| ***F25B 1/00*** | (2006.01) |
| ***F25B 1/10*** | (2006.01) |
| ***F25B 11/02*** | (2006.01) |
| ***F25B 9/00*** | (2006.01) |
| ***F25B 13/00*** | (2006.01) |
| *F25B 1/04* | (2006.01) |

(52) U.S. Cl.

CPC . *F25B 1/005* (2013.01); *F25B 1/10* (2013.01); *F25B 9/008* (2013.01); *F25B 11/02* (2013.01); *F25B 13/00* (2013.01); *F25B 1/04* (2013.01); *F25B 2309/061* (2013.01);

(Continued)

(58) Field of Classification Search

CPC ..... F25B 1/10; F25B 13/00; F25B 9/008; F25B 39/02; F25B 39/022; F25B 41/062; F25B 29/022

USPC ..... 62/498, 515, 510, 519, 115

See application file for complete search history.

(56) References Cited

U.S. PATENT DOCUMENTS

2004/0074254 A1 4/2004 Hiwata et al.

FOREIGN PATENT DOCUMENTS

EP 2381190 A1 10/2011
JP 2004-138332 A 5/2004

(Continued)

OTHER PUBLICATIONS

International Search Report of the International Searching Authority mailed Oct. 25, 2011 for the corresponding international application No. PCT/JP2011/004920 (and English translation).

(Continued)

*Primary Examiner* — Melvin Jones
(74) *Attorney, Agent, or Firm* — Posz Law Group, PLC

(57) ABSTRACT

In a refrigeration cycle device, a design volume ratio, obtained by dividing a stroke volume of a sub-compressor by a stroke volume of an expander, is set to be smaller than (DE/DC)×(hE−hF)/(hB−hA). With an operating efficiency being the maximum in an operating range allowed to be set of the refrigeration cycle device, DE is a density of a refrigerant, which has flowed out from a radiator, DC is a density of the refrigerant, which has flowed out from an evaporator, hE is a specific enthalpy of the refrigerant flowing into the expander, hF is a specific enthalpy of the refrigerant, which has flowed out from the expander, hA is a specific enthalpy of the refrigerant sucked by a main compressor, and hB is a specific enthalpy of the refrigerant at an intermediate position of a compression process of the main compressor.

11 Claims, 7 Drawing Sheets

(52) U.S. Cl.
CPC ..... *F25B 2313/02742* (2013.01); *F25B 2313/0314* (2013.01); *F25B 2313/0315* (2013.01); *F25B 2700/21152* (2013.01)

(56) References Cited

FOREIGN PATENT DOCUMENTS

| | | | |
|---|---|---|---|
| JP | 2005-291622 | A | 10/2005 |
| JP | 2006-242491 | A | 9/2006 |
| JP | 2006-242557 | A | 9/2006 |
| JP | 2009-162438 | A | 7/2009 |
| JP | 2010-038408 | A | 2/2010 |
| JP | 2011-153738 | A | 8/2011 |
| WO | 2010-073586 | A1 | 7/2010 |
| WO | 2011/083510 | A1 | 7/2011 |

OTHER PUBLICATIONS

Office Action mailed Aug. 19, 2014 issued in corresponding JP patent application No. 2013-530882 (and English translation).
Extended European Search Report mailed Mar. 23, 2015 in the corresponding European Patent application No. 11871670.3.
Office Action mailed Mar. 30, 2015 in the corresponding CN application No. 201180073123.2 (with English translation).

REFRIGERATION CYCLE DEVICE

CROSS REFERENCE TO RELATED APPLICATION

This application is a U.S. national stage application of International Application No. PCT/JP2011/004920 filed on Sep. 1, 2011, the disclosure of which is incorporated by reference.

TECHNICAL FIELD

The present invention relates to refrigeration cycle devices, and more particularly relates to a refrigeration cycle device that coaxially couples a compressor and an expander, recovers expansion power which is generated when a refrigerant expands, and uses the expansion power for compression of the refrigerant.

BACKGROUND ART

In recent years, a refrigeration cycle device has been attracting attentions that uses, as a refrigerant, carbon dioxide, which has zero ozonosphere rupture potential and a markedly small global warming potential as compared with those of chlorofluorocarbons. The critical temperature of the carbon dioxide refrigerant is as low as 31.06 degrees C. When a temperature higher than this temperature is used, the refrigerant at a high-pressure side (from the outlet of a compressor, to a radiator, and then to the inlet of a pressure-reducing device) of the refrigeration cycle device becomes a supercritical state in which the refrigerant is not condensed, thereby decreasing operating efficiency (coefficient of performance, COP) of the refrigeration cycle device as compared with a conventional refrigerant. Hence, means for increasing COP is important for the refrigeration cycle device using the carbon dioxide refrigerant.

As such means, there is suggested a refrigeration cycle including an expander instead of the pressure-reducing device and recovering pressure energy during expansion to use the pressure energy as power. Meanwhile, in a refrigeration cycle device with a configuration in which positive-volume compressor and expander are coupled with one shaft, when VC is a stroke volume of the compressor and VE is a stroke volume of the expander, a ratio of circulation volumes of the refrigerants respectively flowing through the compressor and the expander is determined by VC/VE (a design volume ratio). When DC is a density of the refrigerant at the outlet of an evaporator (the refrigerant which flows into the compressor) and DE is a density of the refrigerant at the outlet of the radiator (the refrigerant which flows into the expander), a relationship of "VC×DC=VE×DE," that is, a relationship of "VC/VE=DE/DC" is established since the circulation volumes of the refrigerant flows respectively flowing through the compressor and the expander are equivalent. VC/VE (the design volume ratio) is a constant that is determined when the device is designed. The refrigeration cycle tends to keep balance so that DE/DC (the density ratio) is always constant. (Hereinafter, the phenomenon is called "constraint of constant density ratio.")

However, use conditions of the refrigeration cycle device may not be constant, and hence if the design volume ratio expected at the time of the design differs from the density ratio in the actual operating state, it is difficult to adjust the high-pressure-side pressure to an optimal pressure due to the "constraint of constant density ratio."

Owing to this, there is suggested a configuration and a control method for adjusting the high-pressure-side pressure to the optimal pressure by providing a bypass passage that bypasses the expander and controlling the amount of refrigerant which flows into the expander (for example, see Patent Literature 1).

Also, there is suggested a configuration and a control method for adjusting the high-pressure-side pressure to the optimal pressure by providing a compression bypass passage that bypasses a phase from an intermediate position of a compression process of a main compressor to completion of the compression process and a sub-compressor provided in the compression bypass passage, and controlling the amount of refrigerant which flows into the sub-compressor (for example, see Patent Literature 2).

CITATION LIST

Patent Literature

Patent Literature 1: Japanese Unexamined Patent Application Publication No. 2005-291622 (Claim 1, FIG. 1, etc.)
Patent Literature 2: Japanese Unexamined Patent Application Publication No. 2009-162438 (Abstract, FIG. 1, etc.)

SUMMARY OF INVENTION

Technical Problem

Patent Literature 1 describes the configuration and the control method that can adjust the high-pressure-side pressure to the optimal pressure by causing the refrigerant to flow to the bypass passage that bypasses the expander if the density ratio in the actual operating state is smaller than the design volume ratio; however, the refrigerant flowing through a bypass valve may be subjected to isenthalpic change because of an expansion loss. Hence, there is a problem in which an effect of increasing refrigerating effect, obtained by being subjected to the isentropic change while the expander recovers the expansion energy, is decreased.

Also, if the amount of refrigerant that bypasses the expander is large, the rotation speed of the expander is low and a lubrication state of a sliding portion is degraded. If the rotation speed of the expander becomes excessively low, there are problems in which oil stays in a passage of the expander and hence the oil in the compressor is exhausted and in which reliability is degraded because of, for example, start with the stagnated refrigerant at the time of restart.

Also, Patent Literature 2 intends to address the above-described problems by not bypassing the expander. However, since the bypass valve is provided at the inlet of the sub-compressor, the pressure at the inlet of the sub-compressor is decreased due to a pressure loss, and compression power is increased by that amount. Because of this, there is a problem in which the effect of increasing the operating efficiency may be decreased.

Further, Patent Literature 2 does not describe the method of setting the specifications of the expander, the sub-compressor, and the main compressor to achieve an increase in performance of the refrigeration cycle device in the entire operating range.

The present invention is made to address the problems, and an object of the invention is to provide a refrigeration cycle device capable of providing highly efficient operation by constantly highly efficiently recovering power in a wide operating range even if it is difficult to adjust a high-pressure-side pressure to an optimal pressure due to constraint of constant density ratio.

Solution to Problem

A refrigeration cycle device according to the invention includes a main compressor that compresses a refrigerant from a low pressure to a high pressure; a radiator that dissipates heat of the refrigerant, which has been discharged from the main compressor; an expander that reduces a pressure of the refrigerant, which has passed through the radiator; an evaporator that causes the refrigerant, which has flowed out from the expander, to evaporate; a sub-compression passage having one end connected to a suction pipe, which connects the evaporator with a suction side of the main compressor, and the other end connected to an intermediate position of a compression process of the main compressor; a sub-compressor that is provided in the sub-compression passage, compresses part of the refrigerant with the low pressure, which has flowed out from the evaporator, to an intermediate pressure, and injects the refrigerant to the intermediate position of the compression process of the main compressor; and a driving shaft that connects the expander with the sub-compressor, and transfers power, which is generated when the pressure of the refrigerant is reduced by the expander, to the sub-compressor.

A design volume ratio (VC/VE), which is a value obtained by dividing a stroke volume VC of the sub-compressor by a stroke volume VE of the expander, is set to be smaller than $(DE/DC)\times(hE-hF)/(hB-hA)$ only by a predetermined value, where, under a condition with an operating efficiency being the maximum in an operating range allowed to be set of the refrigeration cycle device, DE is a density of the refrigerant, which has flowed out from the radiator, DC is a density of the refrigerant, which has flowed out from the evaporator, hE is a specific enthalpy of the refrigerant, which flows into the expander, hF is a specific enthalpy of the refrigerant, which has flowed out from the expander, hA is a specific enthalpy of the refrigerant, which is sucked by the main compressor, and hB is a specific enthalpy of the refrigerant at the intermediate position of the compression process of the main compressor.

Advantageous Effects of Invention

With the refrigeration cycle device according to the invention, even if it is difficult to adjust the high-pressure-side pressure to the optimal pressure due to the constraint of constant density ratio, the refrigeration cycle device can provide highly efficient operation by highly efficiently recovering power in a wide operating range.

DESCRIPTION OF EMBODIMENT

Embodiment

Figure 1:
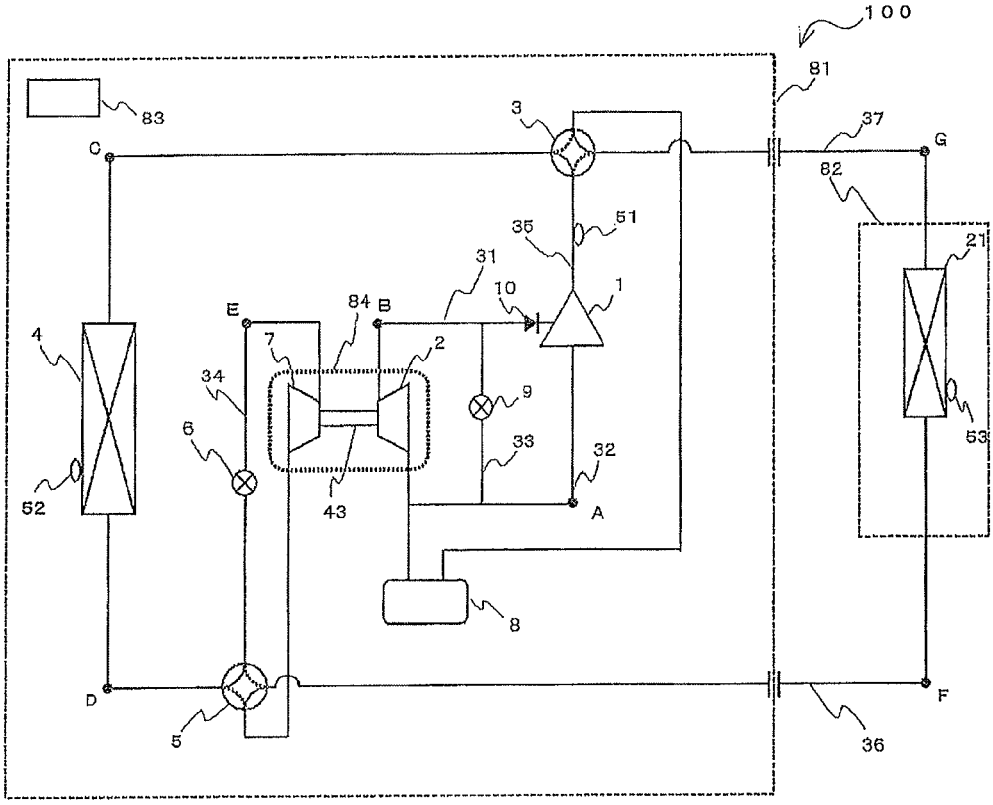
FIG. 1 is a refrigerant circuit diagram of a refrigeration cycle device according to Embodiment of the invention.
Figure 2:
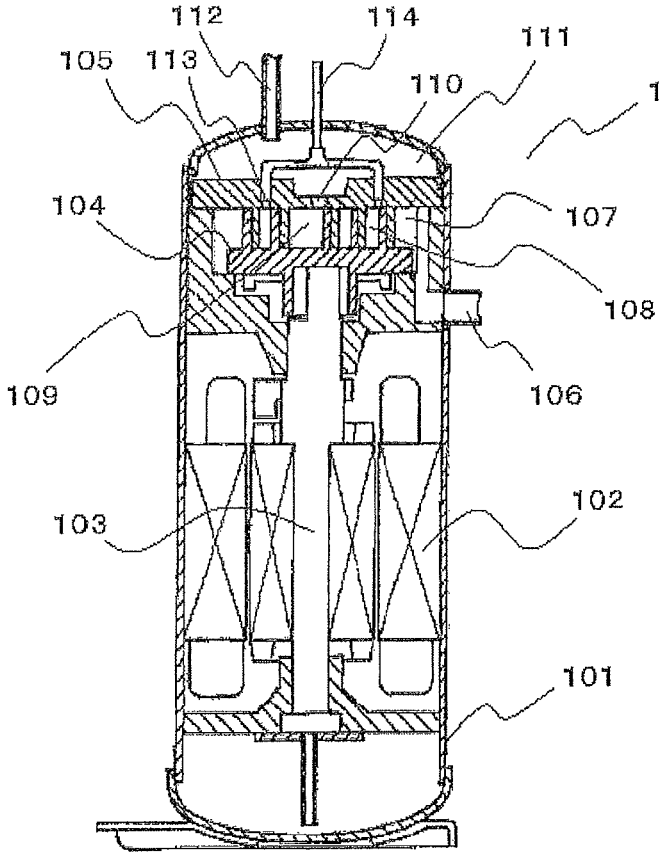
FIG. 2 is a schematic longitudinal section showing a sectional configuration of a main compressor according to Embodiment of the invention.
Figure 3:
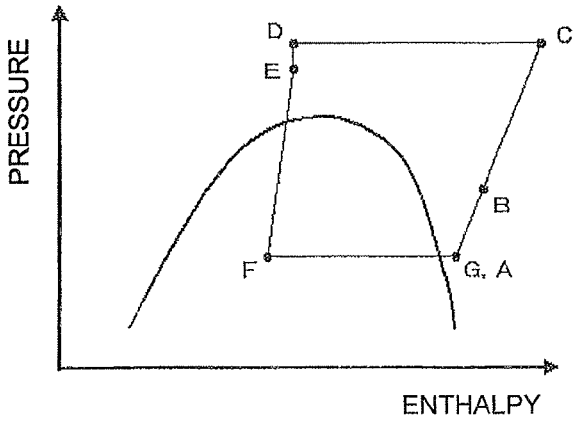
FIG. 3 is a P-h diagram showing transition of a refrigerant during a cooling operation of the refrigeration cycle device according to Embodiment of the invention.
Figure 4:
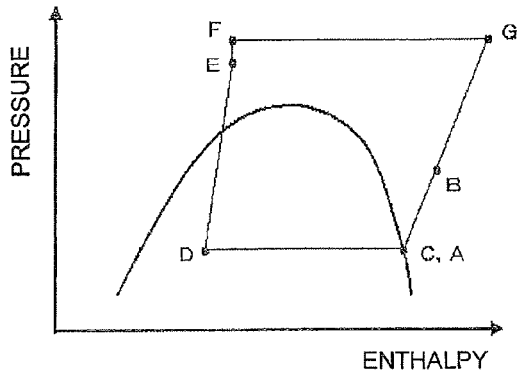
FIG. 4 is a P-h diagram showing transition of the refrigerant during a heating operation of the refrigeration cycle device according to Embodiment of the invention.
Figure 5:
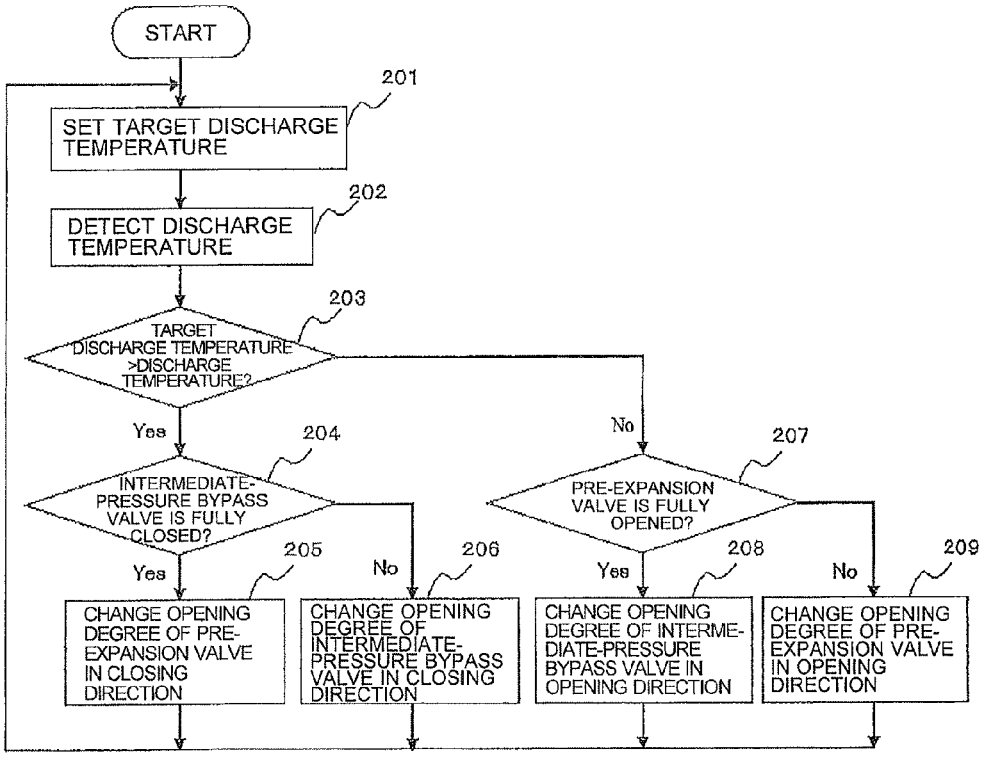
FIG. 5 is a flowchart showing a flow of control processing performed by a controller of the refrigeration cycle device according to Embodiment of the invention.
Figure 6:
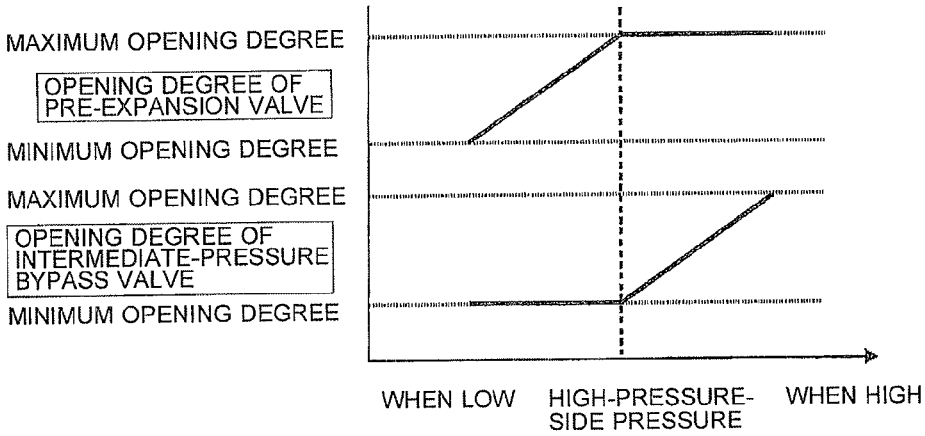
FIG. 6 is an operation explanatory diagram showing associated control of an intermediate-pressure bypass valve and a pre-expansion valve of the refrigeration cycle device according to Embodiment of the invention.

FIG. 1 is a refrigerant circuit diagram of a refrigeration cycle device 100 according to Embodiment of the invention. FIG. 2 is a schematic longitudinal section showing a sectional configuration of a main compressor 1 mounted on the refrigeration cycle device 100. FIG. 3 is a P-h diagram showing transition of a refrigerant during a cooling operation of the refrigeration cycle device 100. FIG. 4 is a P-h diagram showing transition of the refrigerant during a heating operation of the refrigeration cycle device 100. FIG. 5 is a flowchart showing a flow of control processing executed by a controller 83 of the refrigeration cycle device 100. FIG. 6 is an operation explanatory diagram showing associated control of an intermediate-pressure bypass valve 9 and a pre-expansion valve 6 of the refrigeration cycle device 100.

A circuit configuration and an operation of the refrigeration cycle device 100 are described below with reference to FIGS. 1 to 6. It is to be noted that the relationship of sizes of components in FIG. 1 and other drawings may differ from the actual relationship. Also, in FIG. 1 and other drawings, components adhered with the same reference signs correspond to the same or equivalent components. This is common through the whole text of the description. Further, forms of components expressed in the whole text of the description are merely examples, and the components are not limited by the explanation of the example forms.

The refrigeration cycle device 100 at least includes the main compressor 1, an outdoor heat exchanger 4, an expander 7, an indoor heat exchanger 21, and a sub-compressor 2. Also, the refrigeration cycle device 100 includes a first four-way valve 3 serving as a refrigerant passage switching unit, a second four-way valve 5 serving as a refrigerant passage switching unit, the pre-expansion valve 6, an accumulator 8, the intermediate-pressure bypass valve 9, and a check valve 10. Further, the refrigeration cycle device 100 includes the controller 83 that controls the entirety of the refrigeration cycle device 100.

The main compressor 1 includes a motor 102. The motor 102 is connected to a compression part through a shaft 103 serving as a driving shaft. That is, the main compressor 1 compresses a sucked refrigerant and brings the refrigerant into a high-temperature high-pressure state by using a driving force of the motor 102. This main compressor 1 may be a configuration the volume of which can be controlled, for example, an inverter compressor. It is to be noted that the detail of the main compressor 1 is described later with reference to FIG. 2.

The outdoor heat exchanger 4 functions as a radiator in which the refrigerant contained therein transfers heat during a cooling operation, and functions as an evaporator in which the refrigerant contained therein evaporates during a heating operation. For example, the outdoor heat exchanger 4 exchanges heat between the air, which is supplied from a fan (not shown), and the refrigerant.

The outdoor heat exchanger 4 has a heat transferring pipe, through which the refrigerant passes, and a fin for obtaining an increased heat transferring area between the refrigerant flowing through the heat transferring pipe and the outdoor air. The outdoor heat exchanger 4 is configured to exchange heat between the refrigerant and the air (the outdoor air). The outdoor heat exchanger 4 functions as the evaporator during the heating operation. The outdoor heat exchanger 4 causes the refrigerant to evaporate and gasifies (vaporizes) the refrigerant. In some cases, the outdoor heat exchanger 4 may not completely gasify or vaporize the refrigerant, and may bring the refrigerant into a two-phase mixture of gas and liquid (two-phase gas-liquid refrigerant).

In contrast, the outdoor heat exchanger 4 functions as the radiator during the cooling operation. The refrigerant which operates with a critical pressure or lower in a heat-transfer process is condensed in the heat-transfer process, and hence the heat exchanger used in the heat-transfer process may be called condenser or gas cooler. However, in Embodiment, the heat exchanger used in the heat-transfer process is called "radiator" regardless of the type of refrigerant.

The indoor heat exchanger 21 functions as an evaporator in which the refrigerant contained therein evaporates during the cooling operation, and functions as a radiator in which the refrigerant contained therein dissipates heat during the heating operation. For example, the indoor heat exchanger 21 exchanges heat between the air, which is supplied from a fan (not shown), and the refrigerant.

The indoor heat exchanger 21 has a heat transferring pipe, through which the refrigerant passes, and a fin for increasing a heat transferring area between the refrigerant flowing through the heat transferring pipe and the outdoor air. The indoor heat exchanger 21 is configured to exchange heat between the refrigerant and the indoor air. The indoor heat exchanger 21 functions as the evaporator during the cooling operation. The indoor heat exchanger 21 causes the refrigerant to evaporate and gasifies (vaporizes) the refrigerant. In contrast, the indoor heat exchanger 21 functions as the radiator during the heating operation.

The expander 7 reduces the pressure of the refrigerant passing therethrough. Power which is generated when the pressure of the refrigerant is reduced is transferred to the sub-compressor 2 through a driving shaft 43. The sub-compressor 2 is connected to the expander 7 through the driving shaft 43. The sub-compressor 2 is driven by the power which is generated when the expander 7 reduces the pressure of the refrigerant, and the sub-compressor 2 compresses the refrigerant. The refrigeration cycle device 100 according to Embodiment includes a sub-compression passage 31 that connects a suction pipe 32 of the main compressor 1 and an intermediate position of a compression process of the main compressor 1. The sub-compressor 2 is provided in the sub-compression passage 31. That is, the suction side of the sub-compressor 2 is connected in parallel to the main compressor 1, and the discharge side of the sub-compressor 2 is connected to the compression process of the main compressor 1. The expander 7 and the sub-compressor 2 are positive-volume type, and employ a form of, for example, scroll type.

The first four-way valve 3 is provided in a discharge pipe 35 of the main compressor 1, and has a function of switching the flow direction of the refrigerant in accordance with an operating mode. By switching the first four-way valve 3, connection is made between the outdoor heat exchanger 4 and the main compressor 1, between the indoor heat exchanger 21 and the accumulator 8, between the indoor heat exchanger 21 and the main compressor 1, and between the outdoor heat exchanger 4 and the accumulator 8. That is, the first four-way valve 3 performs switching in accordance with the operating mode relating to cooling and heating based on an instruction of the controller 83, and hence switches the passage of the refrigerant.

The second four-way valve 5 connects the expander 7 to the outdoor heat exchanger 4 or the indoor heat exchanger 21 in accordance with the operating mode. By switching the second four-way valve 5, connection is made between the outdoor heat exchanger 4 and the pre-expansion valve 6, and between the indoor heat exchanger 21 and the expander 7; or between the indoor heat exchanger 21 and the pre-expansion valve 6, and between the outdoor heat exchanger 4 and the expander 7. That is, the second four-way valve 5 performs switching in accordance with the operating mode relating to cooling and heating based on an instruction of the controller 83, and hence switches the passage of the refrigerant.

During the cooling operation, the first four-way valve 3 is switched such that the refrigerant flows from the main compressor 1 to the outdoor heat exchanger 4 and flows from the indoor heat exchanger 21 to the accumulator 8, and the second four-way valve 5 is switched such that the refrigerant flows from the outdoor heat exchanger 4 to the indoor heat exchanger 21 through the pre-expansion valve 6 and the expander 7. In contrast, during the heating operation, the first four-way valve 3 is switched such that the refrigerant flows from the main compressor 1 to the indoor heat exchanger 21 and flows from the outdoor heat exchanger 4 to the accumulator 8, and the second four-way valve 5 is switched such that the refrigerant flows from the indoor heat exchanger 21 to the outdoor heat exchanger 4 through the pre-expansion valve 6 and the expander 7. With the second four-way valve 5, the direction of the refrigerant passing through the expander 7 is the same in either of the cooling operation and the heating operation.

The pre-expansion valve 6 may be a configuration, which is provided upstream of the expander 7, which expands the refrigerant by reducing the pressure of the refrigerant, and the opening degree of which is variably controllable, for example, an electronic expansion valve. To be more specific, the pre-expansion valve 6 is provided in a refrigerant passage 34 arranged between the second four-way valve 5 and the inlet of the expander 7 (i.e., between the refrigerant outflow side of the radiator (the outdoor heat exchanger 4 or the indoor heat exchanger 21) and the refrigerant inflow side of the expander 7), and adjusts the pressure of the refrigerant which flows into the expander 7.

The accumulator 8 is provided at the suction side of the main compressor 1, and has a function of storing the liquid refrigerant and preventing the liquid from returning to the main compressor 1 during a transient response of the operating state when an error occurs in the refrigeration cycle device 100 or when operation control is changed. The accumulator 8 has a function of storing the excessive refrigerant in the refrigerant circuit of the refrigeration cycle device 100 and preventing the main compressor 1 from being broken due to returning back by a large amount of the liquid refrigerant returns to the main compressor 1 and the sub-compressor 2 by a large amount.

The intermediate-pressure bypass valve 9 is provided at a bypass passage 33, which is branched from the sub-compression passage 31 arranged between the sub-compressor 2 and the main compressor 1, and which extends to the suction pipe 32 of the main compressor 1. The intermediate-pressure bypass valve 9 controls the flow rate of the refrigerant flowing through the bypass passage 33. The other end of the bypass passage 33 (an end portion opposite to a connection end to the sub-compression passage 31) is connected between the position at which the sub-compression passage 31 is branched from the suction pipe 32 and the main compressor 1. That is, the bypass passage 33 connects a discharge pipe of the sub-compressor 2 (the sub-compression passage 31 between the sub-compressor 2 and the main compressor 1) and the suction pipe 32 of the main compressor. The intermediate-pressure bypass valve 9 may have a configuration of which the opening degree is variably controllable, for example, an electronic expansion valve. By adjusting the opening degree of the intermediate-pressure bypass valve 9, the intermediate pressure, which is the discharge pressure of the sub-compressor 2, can be adjusted.

The check valve 10 is provided in the sub-compression passage 31 of the sub-compressor 2, and adjusts the flow direction of the refrigerant which flows into the main compressor 1 to one direction (a direction from the sub-compressor 2 to the main compressor 1). By providing this check valve 10, backflow of the refrigerant occurring when the discharge pressure of the sub-compressor 2 becomes lower than the pressure of a compressing chamber 108 of the main compressor 1 can be prevented.

For example, the controller 83 controls the driving frequency of the main compressor 1, the rotation speeds of the fans (not shown) provided near the outdoor heat exchanger 4 and the indoor heat exchanger 21, switching of the first four-way valve 3, switching of the second four-way valve 5, the opening degree of the pre-expansion valve 6, and the opening degree of the intermediate-pressure bypass valve 9.

It is to be noted that Embodiment is described while it is expected that the refrigeration cycle device 100 uses carbon dioxide as the refrigerant. Carbon dioxide has characteristics in which an ozonosphere rupture potential is zero and a global warming potential is small as compared with those of a conventional chlorofluorocarbon refrigerant. However, the refrigerant used for the refrigeration cycle device 100 according to Embodiment is not limited to carbon dioxide.

In the refrigeration cycle device 100, the main compressor 1, the sub-compressor 2, the first four-way valve 3, the second four-way valve 5, the outdoor heat exchanger 4, the pre-expansion valve 6, the expander 7, the accumulator83, the intermediate-pressure bypass valve 9, and the check valve 10 are housed in an outdoor unit 81. In the refrigeration cycle device 100, the controller 83 is also housed in the outdoor unit 81. Further, in the refrigeration cycle device 100, the indoor heat exchanger 21 is housed in an indoor unit 82. FIG. 1 exemplarily illustrates a state in which the single outdoor unit 81 (the outdoor heat exchanger 4) is connected to the single indoor unit 82 (the indoor heat exchanger 21) through a liquid pipe 36 and a gas pipe 37; however, the numbers of connected outdoor units 81 and indoor units 82 are not particularly limited.

Also, temperature sensors (a temperature sensor 51, a temperature sensor 52, and a temperature sensor 53) are provided in the refrigeration cycle device 100. The temperature information detected by these temperature sensors is sent to the controller 83, and used for control of configuration units of the refrigeration cycle device 100.

The temperature sensor 51 is provided in the discharge pipe 35 of the main compressor 1, detects the discharge temperature of the main compressor 1 (i.e., the temperature of the refrigerant, which is discharged from the main compressor 1), and may be formed of, for example, a thermistor. The temperature sensor 52 is provided near the outdoor heat exchanger 4 (for example, on the outer surface), detects the temperature of the air which flows into the outdoor heat exchanger 4, and may be formed of, for example, a thermistor. The temperature sensor 53 is provided near the indoor heat exchanger 21 (for example, on the outer surface), detects the temperature of the air which flows into the indoor heat exchanger 21, and may be formed of, for example, a thermistor.

It is to be noted that the installation positions of the temperature sensor 51, the temperature sensor 52, and the temperature sensor 53 are not limited to the positions shown in FIG. 1. For example, the temperature sensor 51 may be installed at any position at which the temperature sensor 51 can detect the temperature of the refrigerant discharged from the main compressor 1, the temperature sensor 52 may be installed at any position at which the temperature sensor 52 can detect the temperature of the air around the outdoor heat exchanger 4, and the temperature sensor 53 may be installed at any position at which the temperature sensor 53 can detect the temperature of the air around the indoor heat exchanger 21.

Then, the configuration and operation of the main compressor 1 are described with reference to FIG. 2. The main compressor 1 is configured such that a shell 101 which forms the outline of the main compressor 1 houses therein, for example, the motor 102 serving as a driving source, the shaft 103 serving as the driving shaft rotationally driven by the motor 102, an oscillating scroll 104 attached to a distal end of the shaft 103 and rotationally driven together with the shaft 103, and a fixed scroll 105 arranged above the oscillating scroll 104 and having a spiral body that meshes with a spiral body of the oscillating scroll 104. Also, an inflow pipe 106 that is connected to the suction pipe 32, an outflow pipe 112 that is connected to the discharge pipe 35, and an injection pipe 114 that is connected to the sub-compression passage 31 are connected to the shell 101.

A low-pressure space 107 that communicates with the inflow pipe 106 is formed in the shell 101, at an outermost periphery portion of the spiral bodies of the oscillating scroll 104 and the fixed scroll 105. A high-pressure space 111 that communicates with the outflow pipe 112 is formed in an upper inner portion of the shell 101. A plurality of compression chambers of which the capacities relatively vary are formed between the spiral body of the oscillating scroll 104 and the spiral body of the fixed scroll (for example, the compression chamber 108 and a compression chamber 109 shown in FIG. 1). The compression chamber 109 represents a compression chamber formed at substantially center portions of the oscillating scroll 104 and the fixed scroll 105. The compression chamber 108 represents a compression chamber formed at an intermediate position of a compression process, at the outside of the compression chamber 109.

An outflow port 110 that allows the compression chamber 109 to communicate with the high-pressure space 111 is provided at the substantially center portion of the fixed scroll 105. An injection port 113 that allows the compression chamber 108 to communicate with the injection pipe 114 is provided at the intermediate position of the compression process of the fixed scroll 105. Also, an Oldham ring (not shown) for preventing rotation movement of the oscillating scroll 104 during eccentric turning movement of the oscillating scroll 104 is arranged in the shell 101. This Oldham ring provides the function of stopping the rotation movement and a function of allowing revolution movement of the oscillating scroll 104.

It is to be noted that the fixed scroll 105 is fixed in the shell 101. Also, the oscillating scroll 104 performs the revolution movement without performing the rotation movement relative to the fixed scroll 105. Further, the motor 102 includes at least a stator that is fixed and held in the shell 101, and a rotor that is rotatably arranged at the side of an inner peripheral surface of the stator and fixed to the shaft 103. The stator has a function of rotationally driving the rotor when the stator is energized. The rotor has a function of being rotationally driven and rotating the shaft 103 when the stator is energized.

The operation of the main compressor 1 is briefly described.

When the motor 102 is energized, a torque is generated at the stator and the rotor forming the motor 102, and the shaft 103 is rotated. Since the oscillating scroll 104 is mounted at the distal end of the shaft 103, the oscillating scroll 104 performs the revolution movement. The compression chamber moves toward the center while the capacity of the compression chamber is decreased by the revolution movement of the oscillating scroll 104, and hence the refrigerant is compressed.

The refrigerant compressed and discharged by the sub-compressor 2 passes through the sub-compression passage 31 and the check valve 10. Then, this refrigerant flows from the injection pipe 114 into the main compressor 1. Meanwhile, the refrigerant passing through the suction pipe 32 flows from the inflow pipe 106 into the main compressor 1. The refrigerant which has flowed from the inflow pipe 106 flows into the low-pressure space 107, is enclosed in the compression chamber, and is gradually compressed. Then, when the compression chamber reaches the compression chamber 108 at the intermediate position of the compression process, the refrigerant flows from the injection port 113 into the compression chamber 108.

That is, the refrigerant which has flowed from the injection pipe 114 is mixed with the refrigerant which has flowed from the inflow pipe 106 in the compression chamber 108. Then, the mixed refrigerant is gradually compressed and reaches the compression chamber 109. The refrigerant which has reached the compression chamber 109 passes through the outflow port 110 and the high-pressure space 111, then is discharged outside the shell 101 through the outflow pipe 112, and passes through the discharge pipe 35.

Next, the operating action of the refrigeration cycle device 100 is described.

<Cooling Operation Mode>

First, the action executed by the refrigeration cycle device 100 during the cooling operation is described with reference to FIGS. 1 and 3. It is to be noted that signs A to G shown in FIG. 1 correspond to signs A to G shown in FIG. 3. Also, in the cooling operation mode, the first four-way valve 3 and the second four-way valve 5 are controlled in a state indicated by "solid lines" in FIG. 1. Here, the high/low level of the pressure in the refrigerant circuit or the like of the refrigeration cycle device 100 is not determined in relation to a reference pressure, but a relative pressure as the result of an increase in pressure by the main compressor 1 or the sub-compressor 2, or a reduction in pressure by the pre-expansion valve 6 or the expander 7 is expressed as a high pressure or a low pressure. Also, the high/low level of the temperature is similarly expressed.

During the cooling operation, a sucked low-pressure refrigerant is sucked into the main compressor 1 and the sub-compressor 2. The low-pressure refrigerant sucked into the sub-compressor 2 is compressed by the sub-compressor 2 and becomes an intermediate-pressure refrigerant (from a state A to a state B). The intermediate-pressure refrigerant compressed by the sub-compressor 2 is discharged from the sub-compressor 2, and is introduced into the main compressor 1 through the sub-compression passage 31 and the injection pipe 114. The intermediate-pressure refrigerant is mixed with the refrigerant sucked into the main compressor 1, is further compressed by the main compressor 1, and becomes a high-temperature high-pressure refrigerant (from the state B to a state C). The high-temperature high-pressure refrigerant compressed by the main compressor 1 is discharged from the main compressor 1, passes through the first four-way valve 3, and flows into the outdoor heat exchanger 4.

The refrigerant which has flowed into the outdoor heat exchanger 4 dissipates heat by exchanging heat with the outdoor air supplied to the outdoor heat exchanger 4, transfers heat to the outdoor air, and becomes a low-temperature high-pressure refrigerant (from the state C to a state D). The low-temperature high-pressure refrigerant flows out from the outdoor heat exchanger 4, passes through the second four-way valve 5, and passes through the pre-expansion valve 6. The pressure of the low-temperature high-pressure refrigerant is reduced when passing through the pre-expansion valve 6 (from the state D to a state E). The refrigerant of which the pressure has been reduced by the pre-expansion valve 6 is sucked into the expander 7. The pressure of the refrigerant sucked into the expander 7 is reduced and the temperature of the refrigerant becomes a low temperature. Hence, the refrigerant becomes a refrigerant in a low quality state (from the state E to a state F).

At this time, power is generated in the expander 7 as the result of the reduction in pressure of the refrigerant. The power is recovered by the driving shaft 43, transferred to the sub-compressor 2, and used for the compression of the refrigerant by the sub-compressor 2. The refrigerant of which the pressure has been reduced by the expander 7 is discharged from the expander 7, passes through the second four-way valve 5, and then flows out from the outdoor unit 81. The refrigerant, which has flowed out from the outdoor unit 81, flows through the liquid pipe 36 and flows into the indoor unit 82.

The refrigerant which has flowed into the indoor unit 82 flows into the indoor heat exchanger 21, receives heat from the indoor air supplied to the indoor heat exchanger 21 and evaporates, and becomes a refrigerant continuously having the low pressure but being in a high quality state (from the state F to a state G). Accordingly, the indoor air is cooled. This refrigerant flows out from the indoor heat exchanger 21, also flows out from the indoor unit 82, flows through the gas pipe 37, and flows into the outdoor unit 81. The refrigerant which has flowed into the outdoor unit 81 passes through the first four-way valve 3, flows into the accumulator 8, and then is sucked again into the main compressor 1 and the sub-compressor 2.

Since the refrigeration cycle device 100 repeats the above-described action, the heat of the indoor air is transferred to the outdoor air and hence the indoor air is cooled.

<Heating Operation Mode>

The action executed by the refrigeration cycle device 100 during the heating operation is described with reference to FIGS. 1 and 4. It is to be noted that signs A to G shown in FIG. 1 correspond to signs A to G shown in FIG. 4. Also, in the heating operation mode, the first four-way valve 3 and the second four-way valve 5 are controlled in a state indicated by "broken lines" in FIG. 1.

During the heating operation, a sucked low-pressure refrigerant is sucked into the main compressor 1 and the sub-compressor 2. The low-pressure refrigerant sucked into the sub-compressor 2 is compressed by the sub-compressor 2 and becomes an intermediate-pressure refrigerant (from the state A to the state B). The intermediate-pressure refrigerant compressed by the sub-compressor 2 is discharged from the sub-compressor 2, and is introduced into the main compressor 1 through the sub-compression passage 31 and the injection pipe 114. The intermediate-pressure refrigerant is mixed with the refrigerant sucked into the main compressor 1, is further compressed by the main compressor 1, and becomes a high-temperature high-pressure refrigerant (from the state B to the state G). The high-temperature high-pressure refrigerant compressed by the main compressor 1 is discharged from the main compressor 1, passes through the first four-way valve 3, and flows out from the outdoor unit 81.

The refrigerant, which has flowed out from the outdoor unit 81, flows through the gas pipe 37 and flows into the indoor unit 82. The refrigerant which has flowed into the indoor unit 82 flows into the indoor heat exchanger 21, dissipates heat by exchanging heat with the indoor air supplied to the indoor heat exchanger 21, transfers heat to the indoor air, and becomes a low-temperature high-pressure refrigerant (from the state G to the state F). Accordingly, the indoor air is heated. This low-temperature high-pressure refrigerant flows out from the indoor heat exchanger 21, also flows out from the indoor unit 82, flows through the liquid pipe 36, and flows into the outdoor unit 81. The refrigerant which has flowed into the outdoor unit 81 passes through the second four-way valve 5, and passes through the pre-expansion valve 6. The pressure of the low-temperature high-pressure refrigerant is reduced when the high-pressure refrigerant passes through the pre-expansion valve 6 (from the state F to the state E).

The refrigerant the pressure of which has been reduced by the pre-expansion valve 6 is sucked into the expander 7. The pressure of the refrigerant sucked into the expander 7 is reduced and the temperature of the refrigerant becomes a low temperature. Hence, the refrigerant becomes a refrigerant in a low quality state (from the state E to the state D). At this time, power is generated in the expander 7 as the result of the reduction in pressure of the refrigerant. The power is recovered by the driving shaft 43, transferred to the sub-compressor 2, and used for the compression of the refrigerant by the sub-compressor 2. The refrigerant the pressure of which has been reduced by the expander 7 is discharged from the expander 7, passes through the second four-way valve 5, and then flows into the outdoor heat exchanger 4. The refrigerant which has flowed into the outdoor heat exchanger 4 receives heat from the outdoor air supplied to the outdoor heat exchanger 4 and evaporates, and becomes a refrigerant continuously having the low pressure but being in a high quality state (from the state D to the state C).

The refrigerant flows out from the outdoor heat exchanger 4, passes through the first four-way valve 3, flows into the accumulator 8, and then is sucked again into the main compressor 1 and the sub-compressor 2.

Since the refrigeration cycle device 100 repeats the above-described action, the heat of the outdoor air is transferred to the indoor air and hence the indoor air is heated.

(Description on Flow Rates of Refrigerant Flowing Through Sub-Compressor and Expander)

Here, the flow rates of the refrigerants of the sub-compressor 2 and the expander 7 are described.

It is assumed that GE is a flow rate of the refrigerant flowing through the expander 7, and GC is a flow rate of the refrigerant flowing through the sub-compressor 2. Also, when it is assumed that W is a ratio of the flow rate (referred to as diverting ratio) of the refrigerant flowing through the sub-compressor 2 from among the total flow rate of the refrigerant flowing to the main compressor 1 and the sub-compressor 2, the relationship between GE and GC is expressed by Expression (1) as follows:

$$GC=W\times GE \quad (1).$$

Hence, when VC is a stroke volume of the sub-compressor 2, VE is a stroke volume of the expander 7, DC is an inflow refrigerant density of the sub-compressor 2, and DE is an inflow refrigerant density of the expander 7, the constraint of constant density ratio is expressed by Expression (2) as follows:

$$VC/VE/W=DE/DC \quad (2).$$

In other words, the design volume ratio (VC/VE) is expressed by Expression (3) as follows:

$$VC/VE=(DE/DC)\times W \quad (3).$$

Also, the diverting ratio W can be determined such that the recovery power at the expander 7 and the compression power at the sub-compressor 2 are substantially equivalent to each other. To be more specific, when hE is an inlet specific enthalpy of the expander 7, hF is an outlet specific enthalpy of the expander 7, hA is an inlet specific enthalpy of the sub-compressor 2, and hB is an outlet specific enthalpy of the sub-compressor 2, the diverting ratio W may be determined to satisfy Expression (4) as follows:

$$hE-hF=W\times(hB-hA) \quad (4).$$

(Effect of Injection)

Since the refrigeration cycle device 100 injects the refrigerant to the main compressor 1 after the sub-compressor 2 compresses part of the low-pressure refrigerant to the intermediate pressure, an electric input of the main compressor 1 can be reduced by the amount of the compression power of the sub-compressor 2.

(Description when Density Ratio Being Different)

Next, the cooling operation at a time when a density ratio (DE/DC) in an actual operating state differs from a design volume ratio (VC/VE/W) expected at the time of the design is described.

[Cooling Operation when (DE/DC)>(VC/VE/W)]

A cooling operation at a time when the density ratio (DE/DC) in the actual operating state is larger than the volume ratio (VC/VE/W) expected at the time of the design is described. In this case, for the constraint of constant density ratio, the refrigeration cycle tends to keep balance in a state in which the high-pressure-side pressure is reduced so that the inlet refrigerant density (DE) of the expander 7 is decreased. However, in the state in which the high-pressure-side pressure is lower than a desirable pressure, operating efficiency may be decreased.

Owing to this, if the intermediate-pressure bypass valve 9 is not a full-close state, the intermediate-pressure bypass valve 9 is operated in the closing direction, so as to increase the intermediate pressure and increase the required compression power of the sub-compressor 2. Then, the rotation speed of the expander 7 tends to decrease, and hence the refrigeration cycle tends to keep balance in a direction in which the inlet density of the expander 7 is increased.

Figure 7:
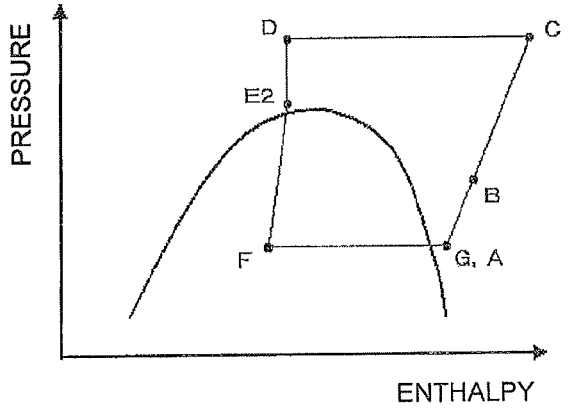
FIG. 7 is a P-h diagram showing transition of the refrigerant when an operation of closing the pre-expansion valve is performed during the cooling operation executed by the refrigeration cycle device according to Embodiment of the invention.

In contrast, if the intermediate-pressure bypass valve 9 is the full-close state, the pre-expansion valve 6 is operated in the closing direction, so as to expand the refrigerant which flows into the expander 7 (from the state D to a state E2) as shown in FIG. 7 and decrease the refrigerant density. Then, the refrigeration cycle tends to keep balance in the direction in which the inlet density of the expander 7 is increased. FIG. 7 is a P-h diagram showing transition of the refrigerant when an operation of closing the pre-expansion valve 6 is performed during the cooling operation executed by the refrigeration cycle device 100.

To be more specific, in the cooling operation of (DE/DC)>(VC/VE/W), the refrigeration cycle device 100 tends to keep balance of the refrigeration cycle in a direction in which the high-pressure-side pressure is increased by control such that the intermediate-pressure bypass valve 9 is closed or the pre-expansion valve 6 is closed. Owing to this, the refrigeration cycle device 100 can increase the high-pressure-side pressure and adjust the high-pressure-side pressure to the desirable pressure. Also, since the refrigerant does not bypass the expander 7, efficient operation can be realized. It is to be noted that the high-pressure-side pressure represents a pressure from the outflow port of the main compressor 1 to the pre-expansion valve 6, and may be a pressure at any position between the outflow port of the main compressor 1 and the pre-expansion valve 6.

[Cooling Operation when (DE/DC)<(VC/VE/W)]

Next, a cooling operation when the density ratio (DE/EC) in the actual operating state is smaller than the volume ratio (VC/VE/W) expected at the time of the design is described. In this case, for the constraint of constant density ratio, the refrigeration cycle tends to keep balance in a state in which the high-pressure-side pressure is increased so that the inlet refrigerant density (DE) of the expander 7 is increased. However, in the state in which the high-pressure-side pressure is higher than the desirable pressure, the operating efficiency may be decreased.

Owing to this, if the pre-expansion valve 6 is not a full-open state, the pre-expansion valve 6 is operated in the opening direction, so that the refrigerant which flows into the expander 7 does not expand, and the refrigerant density is increased. Then, the refrigeration cycle tends to keep balance in the direction in which the inlet density of the expander 7 is decreased.

Figure 8:
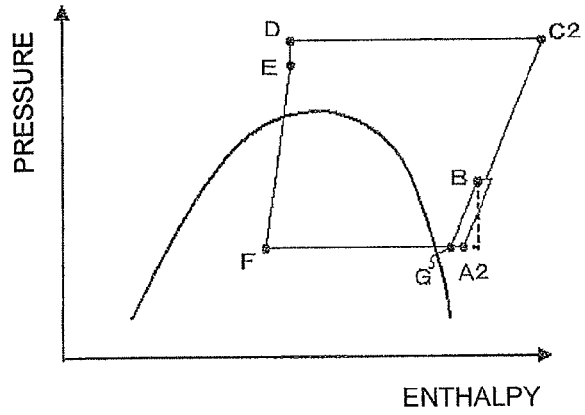
FIG. 8 is a P-h diagram showing transition of the refrigerant when an operation of opening the intermediate-pressure bypass valve is performed during the cooling operation executed by the refrigeration cycle device according to Embodiment of the invention.

In contrast, if the pre-expansion valve 6 is the full-open state, the intermediate-pressure bypass valve 9 is operated in the opening direction. The operation of the refrigerant cycle at this time is described with reference to FIG. 8. FIG. 8 is a P-h diagram showing transition of the refrigerant when an operation of opening the intermediate-pressure bypass valve 9 is performed during the cooling operation executed by the refrigeration cycle device 100.

The sub-compressor 2 compresses the refrigerant, which has flowed out from the accumulator 8, to the intermediate pressure (from the state G to the state B). A part of the refrigerant discharged from the sub-compressor 2 passes through the check valve 10 and is injected to the main compressor 1. Also, residual part of the refrigerant discharged from the sub-compressor 2 passes through the intermediate-pressure bypass valve 9, and joins the refrigerant flowing through the suction pipe 32 of the main compressor 1 (a state A2). The refrigerant in the state A2 sucked to the main compressor 1 joins the refrigerant compressed to the intermediate pressure and injected, and is further compressed (a state C2). Then, the intermediate-pressure is reduced, the required compression power of the sub-compressor 2 is decreased, and hence the rotation speed of the expander 7 tends to be increased. The refrigeration cycle tends to keep balance in the direction in which the inlet density of the expander 7 is decreased.

That is, in the cooling operation of (DE/DC)<(VC/VE/W), the refrigeration cycle device 100 tends to keep balance in a direction in which the high-pressure-side pressure is reduced by control such that the pre-expansion valve 6 is opened or the intermediate-pressure bypass valve 9 is opened. Owing to this, the refrigeration cycle device 100 can adjust the high-pressure-side pressure to the desirable pressure by reducing the high-pressure-side pressure. Also, since the refrigerant does not bypass the expander 7, efficient operation can be realized.

[Heating Operation when (DE/DC)≠(VC/VE/W)]

There may be a case in which the density ratio (DE/DC) in the actual operating state differs from the design volume ratio (VC/VE/W) expected at the time of the design. The operations of the sub-compressor 2 and the expander 7 are controlled like the cooling operation, and hence the description is omitted.

Next, the flow of control processing executed by the controller 83, as a specific operating method of the intermediate-pressure bypass valve 9 and the pre-expansion valve 6, is described with reference to a flowchart shown in FIG. 5.

The refrigeration cycle device 100 uses the correlation between the high-pressure-side pressure and the discharge temperature and executes the control of the intermediate-pressure bypass valve 9 and the pre-expansion valve 6 based on the discharge temperature that can be relatively inexpensively measured, without use of the high-pressure-side pressure that requires an expensive sensor for measurement.

When the refrigeration cycle device 100 is in operation, the optimal high-pressure-side pressure is not always constant. Hence, in the refrigeration cycle device 100, storage means such as a ROM mounted on the controller 83 previously stores data such as the outdoor air temperature detected by the temperature sensor 52 and the indoor temperature detected by the temperature sensor 53, in a form of table. Then, the controller 83 determines a target discharge temperature from the data stored in the storage means (step 201). Then, the controller 83 acquires a detection value (a discharge temperature) from the temperature sensor 51 (step 202). The controller 83 compares the target discharge temperature determined in step 201 with the discharge temperature acquired in step 202 (step 203).

If the discharge temperature is lower than the target discharge temperature (step 203; YES), the high-pressure-side pressure tends to be lower than the optimal high-pressure-side pressure, and hence the controller 83 judges first whether or not the intermediate-pressure bypass valve 9 is fully closed (step 204). If the intermediate-pressure bypass valve 9 is fully closed (step 204; YES), the controller 83 operates the pre-expansion valve 6 in the closing direction (step 205), to reduce the pressure of the refrigerant which flows into the expander 7, to decrease the refrigerant density, and to increase the high-pressure-side pressure and the discharge temperature. If the intermediate-pressure bypass valve 9 is not fully closed (step 204; NO), the controller 83 operates the intermediate-pressure bypass valve 9 in the closing direction (step 206), to increase the intermediate pressure, to increase the required compression power of the sub-compressor 2, and to increase the high-pressure-side pressure and the discharge temperature.

In contrast, if the discharge temperature is higher than the target discharge temperature (step 203; NO), the high-pressure-side pressure tends to be higher than the optimal high-pressure-side pressure, and hence the controller 83 determines first whether or not the pre-expansion valve 6 is fully opened (step 207). If the pre-expansion valve 6 is fully opened (step 207; YES), the controller 83 operates the intermediate-pressure bypass valve 9 in the opening direction (step 208), to reduce the intermediate pressure, to decrease the required compression power of the sub-compressor 2, and to reduce the high-pressure-side pressure and the discharge temperature. Also, if the pre-expansion valve 6 is not fully opened (step 207; NO), the controller 83 operates the pre-expansion valve 6 in the opening direction (step 209), not to reduce the pressure of the refrigerant which flows into the expander 7, and to reduce the high-pressure-side pressure and the discharge temperature.

After these steps, the control returns to step 201, and repeats steps 201 to 209. Since such control is executed, the associated control of the intermediate-pressure bypass valve 9 and the pre-expansion valve 6 can be provided as shown in FIG. 6. To be more specific, the controller 83 adjusts the high-pressure-side pressure by operating the pre-expansion valve 6 if the high-pressure-side pressure is low and the opening degree of the intermediate-pressure bypass valve is a minimum opening degree, and by operating the intermediate-pressure bypass valve 9 if the high-pressure-side pressure is high and the opening degree of the pre-expansion valve 6 is a maximum opening degree. It is to be noted that, in FIG. 6, the horizontal axis indicates the high/low level of the high-pressure-side pressure, the upper section of the vertical axis indicates the opening degree of the pre-expansion valve 6, and the lower section of the vertical axis indicates the opening degree of the intermediate-pressure bypass valve 9.

As described above, the highly efficient operation of the refrigeration cycle device 100 can be achieved by controlling the opening degrees of the pre-expansion valve 6 and the intermediate-pressure bypass valve 9. However, if the difference in pressure at the pre-expansion valve 6 is large or if the flow rate of the refrigerant flowing through the intermediate-pressure bypass valve 9 is large, the power to be recovered is reduced. Hence, the operating efficiency of the refrigeration cycle device 100 may be decreased. Owing to this, a design volume ratio (VC/VE) that can constantly highly efficiently recover the power in a wide operating range and that can highly efficiently maintain the operating efficiency of the refrigeration cycle device 100 is discussed.

Figure 10:
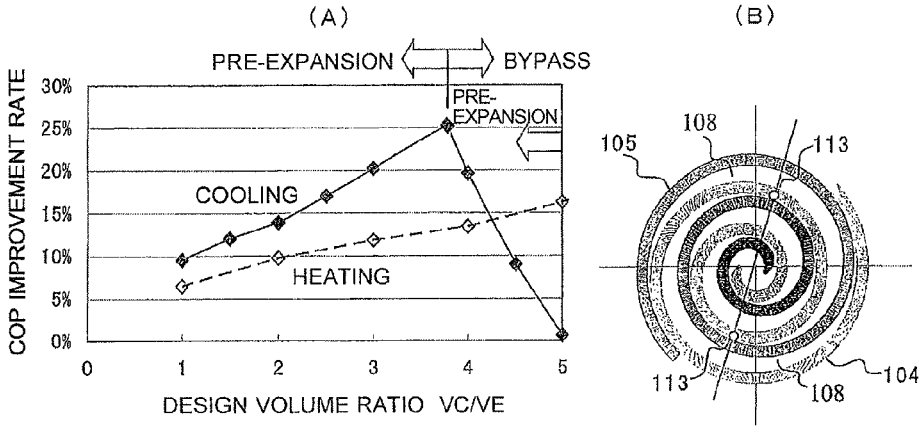
FIG. 10 is a characteristic diagram showing the relationship between the design volume ratio and the COP improvement rate with an example of a main compressor according to Embodiment of the invention (a main compressor having an injection port at an early position).
Figure 11:
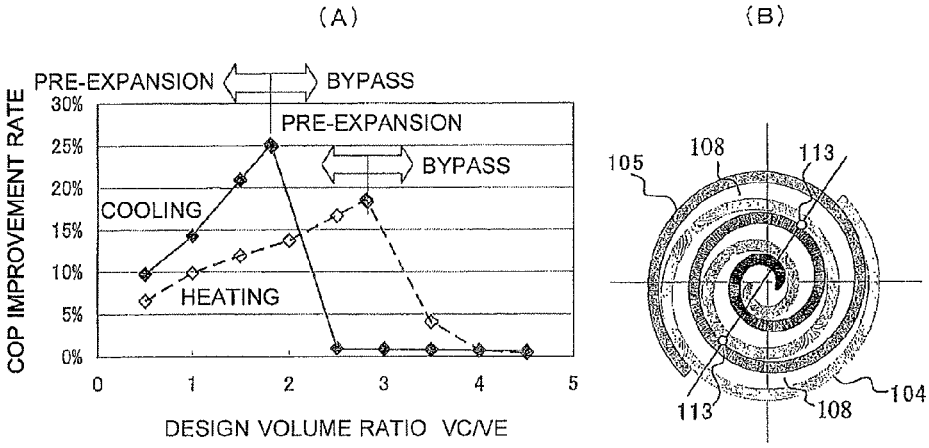
FIG. 11 is a characteristic diagram showing the relationship between the design volume ratio and the COP improvement rate with an example of a main compressor according to Embodiment of the invention (a main compressor having an injection port at an intermediate position).
Figure 12:
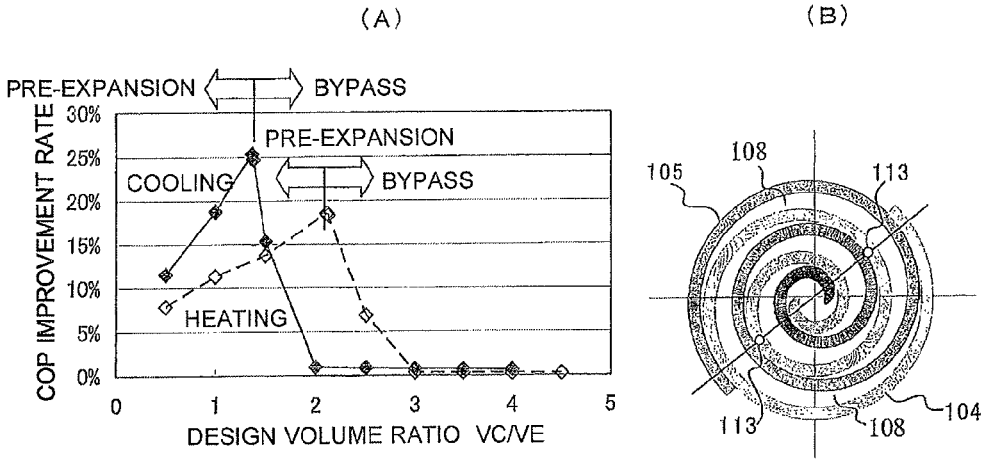
FIG. 12 is a characteristic diagram showing the relationship between the design volume ratio and the COP improvement rate with an example of a main compressor according to Embodiment of the invention (a main compressor having an injection port at a late position).

FIGS. 10 to 12 are characteristic diagrams each showing the relationship between the design volume ratio and the operating efficiency of an example of a main compressor according to Embodiment of the invention. Also, FIGS. 10 to 12 each show the operating efficiency as the COP improvement rate. Part (A) of each figure shows the correlation between the design volume ratio and the COP improvement rate. This COP improvement rate is provided with reference to a COP of a refrigeration cycle device having a refrigerant circuit shown in FIG. 1 by using an expansion valve instead of the expander 7 and the sub-compressor 2. Also, part (B) of each of FIGS. 10 to 12 shows the position of the injection port 113 in a section of a compression part of the main compressor 1 (the oscillating scroll 104 and the fixed scroll 105). Also, FIG. 10 shows a main compressor 1 having an injection port at an early position. FIG. 11 shows a main compressor 1 having an injection port at an intermediate position. FIG. 12 shows a main compressor 1 having an injection port at a late position. When the position of the injection port 113 is described, "early," "intermediate," and "late" are used. The position of the injection port 113 becomes more "early" as the rotation angle by which the injection port 113 is open to the compression chamber 108 becomes small, and the position of the injection port 113 is "late" as the rotation angle becomes large.

As shown in FIGS. 10 to 12, the design volume ratio (VC/VE) with the COP improvement rate being the maximum can be found in both the cooling operation and the heating operation. The design volume ratio (VC/VE) is a position that satisfies Expression (2) for the desirable high-pressure-side pressure. If the high-pressure-side pressure becomes outside the desirable range due to the constraint of constant density ratio, as indicated by a white arrow in each of FIGS. 10 to 12, the high-pressure-side pressure is controlled to be within the desirable pressure range by expansion of the refrigerant by the pre-expansion valve 6 and the bypasses for the refrigerant of the intermediate-pressure bypass valve 9 and the bypass passage 33, and hence the operating efficiency of the refrigeration cycle device 100 is highly efficiently maintained.

Also, referring to FIGS. 10 to 12, it is found that a decrease in COP improvement rate when the design volume ratio (VC/VD) is increased is larger than a decrease in COP improvement rate when the design volume ratio (VC/VD) is decreased, in both of the cooling operation and the heating operation. Accordingly, it is understood that, to markedly increase the COP improvement rate in both the cooling operation and the heating operation, the design volume ratio (VC/VE) may be set smaller only by a predetermined value than a value with the COP improvement rate being the maximum.

Since the design volume ratios (VC/VE) in the cooling operation and the heating operation are the same, the operating condition with the COP improvement rate being the maximum is a condition, under which the ambient temperature of the radiator is the lowest and the ambient temperature of the evaporator is the highest in both of the cooling and heating operations. Hence, the design volume ratio (VC/VE) of the sub-compressor 2 and the expander 7 may be set smaller only by a predetermined value than the design volume ratio (VC/VE) under the operating condition with the COP improvement rate being the maximum.

In other words, based on Expression (4), the diverting ratio W can be expressed by Expression (5) as follows:

$$W=(hE-hF)/(hB-hA) \quad (5).$$

Accordingly, the design volume ratio (VC/VE) of the sub-compressor 2 and the expander 7 can be expressed by Expression (6) as follows by using Expressions (3) and (5):

$$VC/VE=(DE/DC)\times(hE-hF)/(hB-hA) \quad (6).$$

That is, (DE/DC)×(hE−hF)/(hB−hA) under the operating condition with the COP improvement rate being the maximum may be obtained, and the design volume ratio (VC/VE) of the sub-compressor 2 and the expander 7 may be set so as to be smaller than the obtained value only by a predetermined value.

By setting the design volume ratio (VC/VE) of the sub-compressor 2 and the expander 7, even if it is difficult to adjust the high-pressure-side pressure to the optimal pressure due to the constraint of constant density ratio, the power can be highly efficiently recovered in a wide operating range, and hence the operating efficiency of the refrigeration cycle device 100 can be maintained to be highly efficient.

In this case, as understood from FIGS. 10 to 12, it is found that the design volume ratio (VC/VE) with the COP improvement rate being the maximum are different depending on the position of the injection port 113. To be more specific, the more "late" the position of the injection port 113 is, the smaller the design volume ratio (VC/VE) with the COP improvement rate being the maximum becomes. Also, the intermediate pressure, which is an intermediate position of the compression process of the main compressor 1, are different depending on the position of the injection port 113. Hence, if the design volume ratio (VC/VE) of the sub-compressor 2 and the expander 7 is set with regard to the position of the injection port 113, the refrigeration cycle device 100 can be more efficiently operated.

Figure 13:
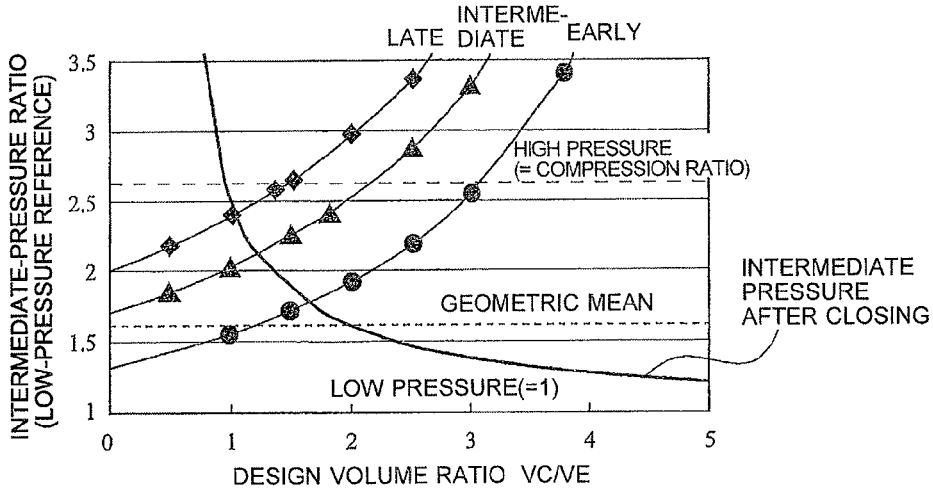
FIG. 13 is a characteristic diagram showing the relationship between the design volume ratio and the intermediate pressure under a cooling condition having a difference in position of the injection port of the main compressor according to Embodiment of the invention.

FIG. 13 is a characteristic diagram showing the relationship between the design volume ratio and the intermediate pressure under a cooling condition having a difference in position of the injection port of the main compressor according to Embodiment of the invention. FIG. 13 shows an intermediate pressure and a high pressure with reference to a low pressure serving as "1." The intermediate pressure is a pressure in the compression chamber 108 after the refrigerant is injected from the sub-compressor 2 to the compression chamber 108 of the main compressor 1 and the passage between the compression chamber 108 and the injection port 113 is closed.

FIG. 13 shows three curves extending toward the upper right side including "early," "intermediate," and "late" corresponding to the main compressors 1 shown in FIGS. 10 to 12. These are intermediate pressures when the refrigerant by the amount corresponding to the diverting ratio W determined by the design volume ratio (VC/VE) is reliably entirely injected from the sub-compressor 2 to the compression chamber 108 of the main compressor 1. Also, FIG. 13 shows a curve extending toward the lower right side. This is a discharge pressure when the refrigerant by the diverting ratio W determined by the amount corresponding to the design volume ratio (VC/VE) is discharged from the sub-compressor 2. A region, which is located at the left side of the intersection between the curve extending toward the upper right side indicative of the intermediate pressure after closing at the position of the injection port 113 and the curve extending toward the lower right side indicative of the pressure of the compression by the sub-compressor 2, and which is defined by the curves extending toward the upper right side and the curve extending toward the lower right side is an operable intermediate pressure. For example, when the curve of the intermediate pressure after closing in FIG. 13 is considered as an example, if the design volume ratio (VC/VE) is 1 with reference to the intersection with the "late" curve extending toward the upper light side, the intermediate pressure after closing of the main compressor 1 shown in FIG. 12 becomes about 2.2.

A broken line in FIG. 13 indicates a geometric mean of the high pressure and the low pressure. If the design volume ratio (VC/VE) is changed, the injection flow rate is changed, and hence the intermediate pressure is changed. The value of the curve extending toward the upper right side when the design volume ratio (VC/VE)=0 indicates the intermediate pressure with the injection flow rate being zero. This indicates the intermediate pressure at each of the positions of the injection ports. The intermediate pressure when the position of the injection port is "intermediate" almost corresponds to the geometric mean of the high pressure and the low pressure.

Referring to FIG. 13, it is found that the intermediate pressure after closing is increased as the position of the injection port 113 becomes "late." This is because the volume of the compression chamber 108 is decreased as the position of the injection port 113 becomes "late." Accordingly, the flow rate of the refrigerant to be injected relatively is increased. If the intermediate pressure after closing is too high, the refrigerant cannot be injected from the sub-compressor 2 to the main compressor 1 due to the following reason. Accordingly, the high pressure cannot be controlled, the pressure is increased, and the operating efficiency may be degraded.

Also, at the intersection between the curve extending toward the upper right side and the curve extending toward the lower right side in FIG. 13, the discharge pressure of the sub-compressor 2 corresponds to the intermediate pressure after closing at the position of the injection port 113 of the main compressor 1, and the COP improvement rate becomes the maximum.

That is, assuming the recovery power at the expander 7 is substantially equivalent to the compression power at the sub-compressor 2, Expression (4) is provided. However, in strict sense, the outlet specific enthalpy hB provided by Expression (4) is not the outlet specific enthalpy of the sub-compressor 2, but represents a specific enthalpy at an intermediate position (that is, the position at which the refrigerant is injected from the sub-compressor 2) of the compression process of the main compressor 1. Hence, if the outlet specific enthalpy of the sub-compressor 2 is hB', (hB−hA) of Expression (4) becomes Expression (7) as follows:

$$hB-hA=hB'-hA+\alpha\geq hB'-hA \quad (7).$$

That is, a difference in enthalpy from the inlet of the main compressor 1 to the intermediate position of the compression process is larger than a difference in enthalpy from the inlet to the outlet of the sub-compressor 2. The factor is required power (a portion corresponding to α) for injecting the refrigerant discharged from the sub-compressor 2, to the main compressor 1. That is, in strict sense, "the recovery power at the expander 7" does not match "the compression power at the sub-compressor 2" but matches "the sum of the compression power at the sub-compressor 2 and the inflow work of the sub-compressor 2 to the main compressor 1." Hence, if the intermediate pressure after closing is too high, the inflow work from the sub-compressor 2 to the main compressor 1 is increased, and the refrigerant is no longer injected from the sub-compressor 2 to the main compressor 1.

Figure 14:
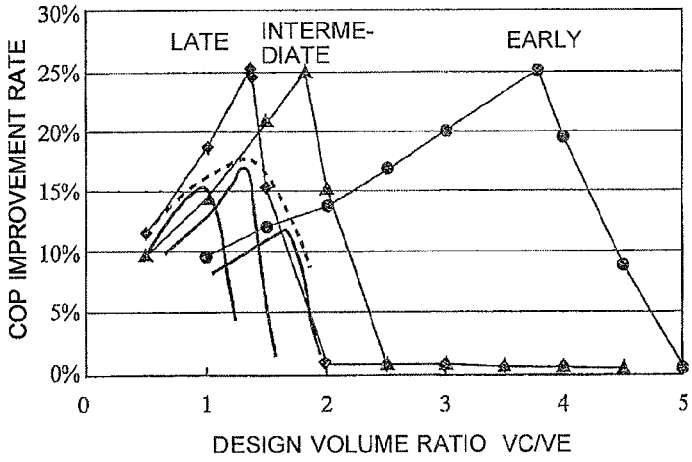
FIG. 14 reflects the result of FIG. 13 to the relationship between the design volume ratio and the COP improvement rate under the cooling conditions shown in FIGS. 10 to 12.

FIG. 14 reflects the result of FIG. 13 to the relationship between the design volume ratio and the COP improvement rate under the cooling conditions shown in FIGS. 10 to 12. Three curves indicated by thick lines and protruding upward in FIG. 14 are COP improvement rates in cases of "late,"

"intermediate," and "early" from the left. A broken line is an envelope of peaks of these curves. The envelope is also a curve having the maximum value (a curve protruding upward). In FIG. 14, it is found that the COP improvement rate is decreased as the position of the injection port 113 is shifted from "intermediate" to "late." This is because the injection flow rate is increased as the position of the injection port 113 is shifted from "intermediate" to "late." Hence, the required power (the portion corresponding to α) for injecting the refrigerant to the main compressor 1 is increased due to a pressure loss. Also, it is found that the COP improvement rate decreases as the position of the injection port 113 shifts from "intermediate" to "early." This is because it becomes more difficult to inject the refrigerant from the sub-compressor 2 to the main compressor 1 due to the formation position of the injection port 113; it becomes more difficult to inject the refrigerant as the position of the injection port 113 shifts from "intermediate" to "early." Since the required power (the portion corresponding to α) has a large uncertainty, it is preferable to determine the position of the injection port 113 from "intermediate" to "early."

Figure 15:
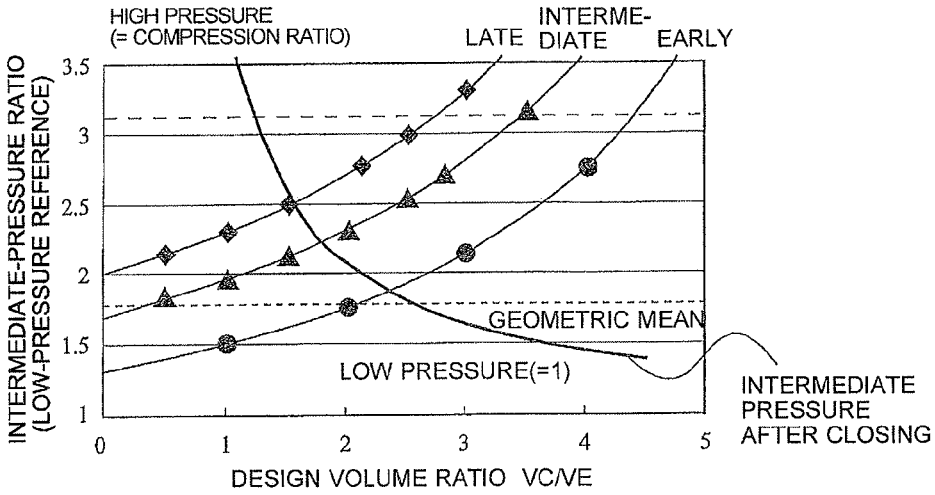
FIG. 15 is a characteristic diagram showing the relationship between the design volume ratio and the intermediate pressure under a heating condition having a difference in position of the injection port of the main compressor according to Embodiment of the invention.
Figure 16:
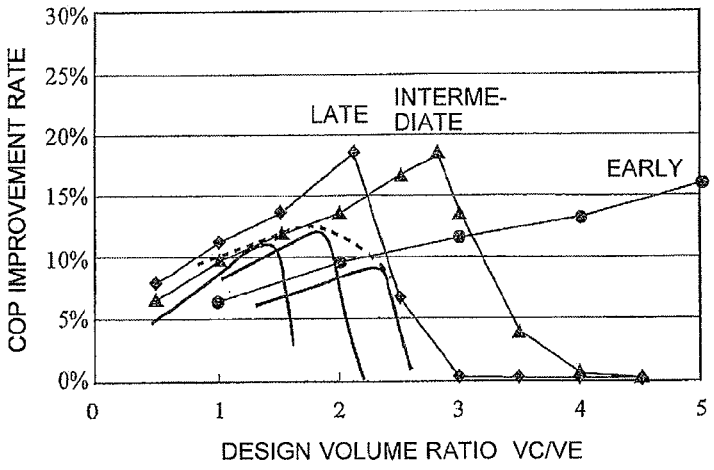
FIG. 16 reflects the result of FIG. 15 to the relationship between the design volume ratio and the COP improvement rate under the heating conditions shown in FIGS. 10 to 12.

Also, FIG. 15 is a characteristic diagram showing the relationship between the design volume ratio and the intermediate pressure under a heating condition having a difference in position of the injection port of the main compressor according to Embodiment of the invention. FIG. 16 reflects the result of FIG. 15 to the relationship between the design volume ratio and the COP improvement rate under the heating conditions shown in FIGS. 10 to 12. Even under the heating condition, similarly to the cooling condition, it is found that the COP improvement rate decreases as the position of the injection port 113 shifts from "intermediate" to "late." Similarly to the cooling condition, this is because the injection flow rate increases as the position of the injection port 113 shifts from "Intermediate" to "late." Hence, the required power (the portion corresponding to α) for injecting the refrigerant to the main compressor 1 is increased due to a pressure loss. Also, it is found that the COP improvement rate decreases as the position of the injection port 113 shifts from "intermediate" to "early."

Similarly to the cooling condition, this is because it becomes more difficult of inject the refrigerant from the sub-compressor 2 to the main compressor 1 due to the formation position of the injection port 113; it is more difficult to inject the refrigerant as the position of the injection port 113 shifts from "intermediate" to "early." Since the required power (the portion corresponding to α) has a large uncertainty, under the heating condition, similarly to the cooling condition, it is preferable to determine the position of the injection port 113 from "intermediate" to "early."

In Embodiment, the position of the injection port 113 and the design volume ratio (VC/VE) are determined so that the required power for injecting the refrigerant to the main compressor 1 does not become excessively large, that is, the intermediate pressure after closing does not become excessively large. To be specific, the intermediate pressure (more specifically, the intermediate pressure after closing) is set so as to be equal to or smaller than a geometric mean value between the high pressure (the discharge pressure of the main compressor 1) and the low pressure (the suction pressure of the main compressor 1) under the operating condition with the COP improvement rate being the maximum in the operating range allowed to be set. Then, the position of the injection port 113 and the design volume ratio (VC/VE) are determined to attain the intermediate pressure.

As described above, by preventing the required power for injecting the refrigerant to the main compressor 1 from being excessively large, that is, by preventing the intermediate pressure after closing from being excessively large, the refrigeration cycle device 100 can be further highly efficiently operated. Also, generally, if the intermediate pressure is set at a geometric mean value of the high pressure and the low pressure or smaller, the refrigeration cycle device can be highly efficiently operated. Hence, the intermediate pressure (more specifically, the intermediate pressure after closing) is set so as to be equal to or smaller than a geometric mean value between the high pressure (the discharge pressure of the main compressor 1) and the low pressure (the suction pressure of the main compressor 1) under the operating condition with the COP improvement rate being the maximum in the operating range allowed to be set. Accordingly, the refrigeration cycle device 100 can be further highly efficiently operated.

Also, if the intermediate pressure after closing becomes excessively large, excessive compression occurs in the compression process (the compression process from the intermediate pressure to the high pressure) of the main compressor 1 after the injection, electric input of the main compressor 1 may be increased, and the operating efficiency of the refrigeration cycle device 100 may be decreased. Owing to this, the design volume ratio (VC/VE) is set with regard to a decrease in operating efficiency due to excessive compression, in addition to a decrease in operating efficiency due to the inflow work from the sub-compressor 2 to the main compressor 1. Accordingly, the refrigeration cycle device 100 can be further highly efficiently operated.

As shown in FIGS. 14 and 16, the COP is decreased if the position of the injection port is "late." If the design volume ratio (VC/VE) is set within a range from 1 to 2.5, the high COP can be provided in the operating range of the refrigeration cycle device.

In the refrigeration cycle device 100 according to Embodiment, $(DE/DC)\times(hE-hF)/(hB-hA)$ under the operating condition with the COP improvement rate being the maximum in the operating conditions allowed to be set may be obtained, and the design volume ratio (VC/VE) of the sub-compressor 2 and the expander 7 may be set so as to be smaller than the obtained value only by a predetermined value. Accordingly, even if it is difficult to adjust the high-pressure-side pressure to the optimal pressure due to the constraint of constant density ratio, the power can be highly efficiently recovered in a wide operating range, and the operating efficiency of the refrigeration cycle device 100 can be highly efficiently maintained.

In the refrigeration cycle device 100 according to Embodiment, the position of the injection port 113 and the design volume ratio (VC/VE) are determined so that the required power for injecting the refrigerant to the main compressor 1 does not become excessively large, that is, the intermediate pressure after closing does not become excessively large. To be specific, the intermediate pressure (more specifically, the intermediate pressure after closing) is set so as to be equal to or smaller than a geometric mean value between the high pressure (the discharge pressure of the main compressor 1) and the low pressure (the suction pressure of the main compressor 1) under the operating condition with the COP improvement rate being the maximum in the operating range allowed to be set. Then, the position of the injection port 113 and the design volume ratio (VC/VE) are determined to attain the intermediate pressure. Accordingly, the refrigeration cycle device 100 can be further highly efficiently operated.

Also, in the refrigeration cycle device 100 according to Embodiment, since the design volume ratio (VC/VE) is set in the range from 1 to 2.5, the refrigeration cycle device 100 can be further highly efficiently operated.

Also, in the refrigeration cycle device 100 according to Embodiment, with the opening-degree operation for the intermediate-pressure bypass valve 9 and the pre-expansion valve 6, the high-pressure-side pressure can be adjusted to the desirable high-pressure-side pressure, and the power can be reliably recovered without bypassing the expander 7. Accordingly, the refrigeration cycle device 100 can be further highly efficiently operated.

Also, the refrigeration cycle device 100 according to Embodiment can reduce likelihood of occurrence of phenomena expected if the amount by which the refrigerant bypasses the expander 7 is large and causing degradation of reliability, for example, degradation in lubrication state and expansion at a sliding portion because of a low rotation speed of the expander 7, exhaustion of oil in the compressor because the oil stays in the passage of the expander 7, and start with a stagnated refrigerant at the time of restart.

Also, in the refrigeration cycle device 100 according to Embodiment, since an expander bypass valve is not required, an expansion loss that is generated when the refrigerant is expanded by the expander bypass valve is not generated, and a decrease in refrigerating effect at the evaporator can be restricted.

Also, in the refrigeration cycle device 100 according to Embodiment, even when the sub-compressor 2 can hardly compress the refrigerant, part of the circulating refrigerant is caused to flow into the sub-compressor 2. Owing to this, with the refrigeration cycle device 100, as compared with a case in which the entire amount of the circulating refrigerant is caused to flow, the sub-compressor 2 serves as a passage resistance for the refrigerant, and hence the performance is not degraded. The case in which the sub-compressor 2 can hardly compress the refrigerant is, for example, a case in which the difference between the high-pressure-side pressure and the low-pressure-side pressure is small and the recovery power of the expander 7 is excessively small, such as the cooling operation with a low outdoor air temperature, or the heating operation with a low indoor temperature.

Also, the refrigeration cycle device 100 according to Embodiment is configured such that the compression function is divided into the main compressor 1 having the driving source, and the sub-compressor 2 driven by the power of the expander 7. Hence, with the refrigeration cycle device 100, the structure design and function design can be divided. Hence, problems in view of design and manufacturing are less than those of an integrated apparatus of the driving source, expander, and compressor.

Also, in the refrigeration cycle device 100 according to Embodiment, the target value of the opening-degree operation for the intermediate-pressure bypass valve 9 and the pre-expansion valve 6 is the discharge temperature of the main compressor 1; however, a pressure sensor may be provided in the discharge pipe 35 of the main compressor 1 and the control may be based on the discharge pressure.

In the refrigeration cycle device 100 according to Embodiment, the target value of the opening-degree operation for the intermediate-pressure bypass valve 9 and the pre-expansion valve 6 is the discharge temperature of the main compressor 1; however, the target value may be a degree of superheat at the refrigerant outlet of the indoor heat exchanger 21 functioning as the evaporator during the cooling operation. In this case, the controller 83 may previously store information from a pressure sensor that is arranged in the refrigerant pipe between the outlet of the expander 7 and the main compressor 1 or the sub-compressor 2 and detects a low-pressure-side pressure, and information from a temperature sensor that detects a refrigerant outlet temperature of the indoor heat exchanger 21, in a form of table in a ROM or the like, and the controller 83 may determine a target degree of superheat.

Also, a controller may be provided in the indoor unit 82 and a target degree of superheat may be set. In this case, the target degree of superheat may be sent to the controller 83 through communication between the indoor unit 82 and the outdoor unit 81 in a wired or wireless manner.

Further, regarding the relationship of the degree of superheat between the high-pressure-side pressure and the evaporator, the higher the high-pressure-side pressure, the larger the degree of superheat, and the lower the high-pressure-side pressure, the smaller the degree of superheat. Thus, control may be executed such that the discharge temperature in step 203 of the flowchart in FIG. 5 is replaced with the degree of superheat.

In the refrigeration cycle device 100 according to Embodiment, the target value of the opening-degree operation for the intermediate-pressure bypass valve 9 and the pre-expansion valve 6 is the discharge temperature of the main compressor 1; however, the target value may be a degree of subcooling at the refrigerant outlet of the indoor heat exchanger 21 functioning as the radiator during the heating operation.

Figure 9:
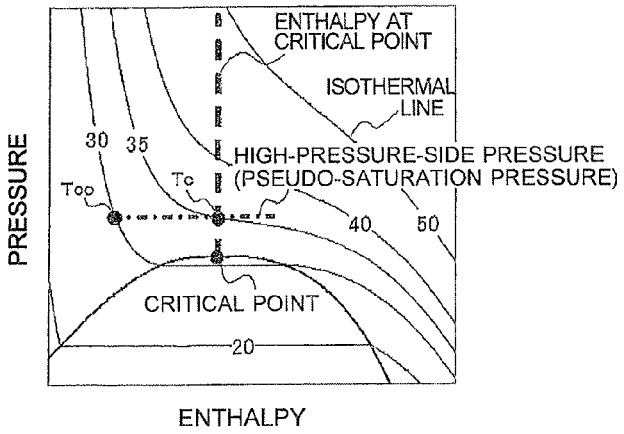
FIG. 9 is a P-h diagram showing part of transition of a carbon dioxide refrigerant.

Carbon dioxide is used as the refrigerant of the refrigeration cycle device 100 according to Embodiment. When such refrigerant is used, if the air temperature of the radiator is high, the refrigerant is not condensed at the high-pressure side unlike a conventional chlorofluorocarbon refrigerant and is brought into a supercritical cycle. Hence, the degree of subcooling cannot be calculated from a saturation pressure and a saturation temperature. Owing to this, as shown in FIG. 9, a pseudo-saturation pressure and a pseudo-saturation temperature Tc are determined with reference to an enthalpy at a critical point, and the difference with respect to a refrigerant temperature Tco may be used as a pseudo-degree of subcooling Tsc (see Expression (8) as follows):

$$Tsc=Tc-Tco \quad (8).$$

Also, regarding the relationship between the high-pressure-side pressure and the degree of superheat of the radiator, the higher the high-pressure-side pressure, the larger the degree of subcooling, and the lower the high-pressure-side pressure, the smaller the degree of subcooling. Thus, control may be executed such that the discharge temperature in step 203 of the flowchart in FIG. 5 is replaced with the degree of subcooling.

Also, in the refrigeration cycle device 100 according to Embodiment, the refrigerant compressed by the sub-compressor 2 is injected to the compression chamber 108 of the main-compressor 1. Alternatively, for example, the compression mechanism of the main compressor 1 may be divided into two-stage compression and the refrigerant may be injected to a passage connecting a low-stage-side compression chamber and a downstream-stage-side compression chamber. Still alternatively, the main compressor 1 may be configured to execute two-stage compression by a plurality of compressors.

In the refrigeration cycle device 100 according to Embodiment, the outdoor heat exchanger 4 and the indoor heat exchanger 21 are each a heat exchanger that exchanges heat with the air; however, the configuration is not limited to the above, and may employ a heat exchanger that exchanges heat with other heat medium, such as water or brine.

Also, in the refrigeration cycle device 100 according to Embodiment, it is exemplarily described that the refrigerant passage is switched in accordance with the operation mode relating to cooling and heating, by the first four-way valve 3 and the second four-way valve 5; however, the configuration is not limited to the above. For example, a two-way valve, a three-way valve, or a check valve may switch the refrigerant passage.

INDUSTRIAL APPLICABILITY

The present invention is suitable for, for example, a hot-water supply device, a home-use refrigeration cycle device, a commercial-use refrigeration cycle device, or a vehicle-use refrigeration cycle device. A refrigeration cycle device that constantly recovers power in a wide operating range and is highly efficiently operated can be provided. In particular, a refrigeration cycle device that uses carbon dioxide as a refrigerant and has a high-pressure side in a super critical state is advantageous. For example, if the refrigeration cycle device according to the invention is used for a hot-water supply device, the design volume ratio (VC/VE) of the sub-compressor 2 and the expander 7 may be set so that the operating condition with the COP improvement rate being the maximum in the operating conditions allowed to be set may be determined as a condition in which the ambient temperature of the evaporator is the highest, the water temperature of water which flows into the radiator is the lowest, and the water temperature of water which flows out from the radiator (a set hot-water outflow temperature) is the lowest.

REFERENCE SIGNS LIST

1 main compressor 2 sub-compressor 3 first four-way valve 4 outdoor heat exchanger 5 second four-way valve 6 pre-expansion valve 7 expander 8 accumulator 9 intermediate-pressure bypass valve 10 check valve 21 indoor heat exchanger 31 sub-compression passage 32 suction pipe 33 bypass passage 34 refrigerant passage 35 discharge pipe 36 liquid pipe 37 gas pipe 43 driving shaft 51, 52, 53 temperature sensor 81 outdoor unit 82 indoor unit 83 controller 84 hermetically sealed container 100 refrigeration cycle device 101 shell 102 motor 103 shaft 104 oscillating scroll 105 fixed scroll 106 inflow pipe 107 low-pressure space 108 compression chamber 109 compression chamber 110 outflow port 111 high-pressure space 112 outflow pipe 113 injection port 114 injection pipe.

The invention claimed is:

1. A refrigeration cycle device comprising:

a main compressor that compresses a refrigerant from a low pressure to a high pressure;

a radiator that dissipates heat of the refrigerant, which has been discharged from the main compressor;

an expander that reduces a pressure of the refrigerant, which has passed through the radiator;

an evaporator that causes the refrigerant, which has flowed out from the expander, to evaporate;

a sub-compression passage having one end connected to a suction pipe, which connects the evaporator with a suction side of the main compressor, and the other end connected to an intermediate position of a compression process of the main compressor;

a sub-compressor that is provided in the sub-compression passage, compresses a part of the refrigerant with the low pressure, the part which has flowed out from the evaporator, to an intermediate pressure, and injects the refrigerant to the intermediate position of the compression process of the main compressor; and a driving shaft that connects the expander with the sub-compressor, and transfers power, which is generated when the pressure of the refrigerant is reduced by the expander, to the sub-compressor, wherein a design volume ratio (VC/VE), which is a value obtained by dividing a stroke volume VC of the sub-compressor by a stroke volume VE of the expander, is set to be smaller than (DE/DC)×(hE−hF)/(hB−hA), and wherein, under a condition with an operating efficiency being the maximum in an operating range allowed to be set of the refrigeration cycle device, DE is a density of the refrigerant, which has flowed out from the radiator, DC is a density of the refrigerant, which has flowed out from the evaporator, hE is a specific enthalpy of the refrigerant, which flows into the expander, hF is a specific enthalpy of the refrigerant, which has flowed out from the expander, hA is a specific enthalpy of the refrigerant, which is sucked by the main compressor, and hB is a specific enthalpy of the refrigerant at the intermediate position of the compression process of the main compressor.

2. The refrigeration cycle device of claim 1, wherein the refrigeration cycle device is used for an air-conditioning apparatus, wherein the radiator and the evaporator are each a heat exchanger in which heat is exchanged between the air and the refrigerant, and wherein the condition by which the operating efficiency becomes the maximum in the operating range allowed to be set of the refrigeration cycle device is an operating state in which an ambient temperature of the radiator is the lowest and an ambient temperature of the evaporator is the highest.

3. The refrigeration cycle device of claim 2, wherein the refrigeration cycle device can perform cooling and heating, and wherein the design volume ratio (VC/VE) is set to be equal to or smaller than (DE/DC)×(hE−hF)/(hB−hA) during a heating operation and equal to or larger than (DE/DC)×(hE−hF)/(hB−hA) during a cooling operation.

4. The refrigeration cycle device of claim 1, wherein an intermediate pressure of the refrigerant at a connection position of the main compressor with the sub-compression passage is set to be smaller than a geometric mean value of the low pressure and the high pressure under the condition by which the operating efficiency becomes the maximum in the operating range allowed to be set of the refrigeration cycle device.

5. The refrigeration cycle device of claim 1, wherein the design volume ratio (VC/VE) is 2.5 or smaller.

6. The refrigeration cycle device of claim 1, wherein the design volume ratio (VC/VE) is 1 or larger.

7. The refrigeration cycle device of claim 1, further comprising:

a pre-expansion valve that is provided between the expander and the radiator, and reduces the pressure of the refrigerant, which flows into the expander;

a bypass passage that connects a discharge-side pipe of the sub-compressor with the suction pipe;

a bypass valve that is provided in the bypass passage and adjusts a flow rate of the refrigerant flowing through the bypass passage; and a controller that controls an opening degree of the pre-expansion valve and an opening degree of the bypass valve.

8. The refrigeration cycle device of claim 7, wherein the controller controls the opening degree of the pre-expansion valve and the opening degree of the bypass valve to adjust a high-pressure-side pressure of the refrigerant.

9. The refrigeration cycle device of claim 7,
wherein the controller controls the opening degree of the pre-expansion valve and the opening degree of the bypass valve to adjust a temperature of the refrigerant, which is discharged from the main compressor.

10. The refrigeration cycle device of claim 7,
wherein an end portion at the side of the suction pipe of the bypass passage is connected to the suction pipe in an area between a connection portion of the sub-compression passage with the suction pipe and the main compressor.

11. The refrigeration cycle device of claim 1,
wherein carbon dioxide is used as the refrigerant.

* * * * *